United States Patent [19]

Tatara

[11] Patent Number: 4,498,795

[45] Date of Patent: Feb. 12, 1985

[54] SEMIAUTOMATIC PAPER SETTING SYSTEM

[75] Inventor: Yoshikuni Tatara, Yokohama, Japan

[73] Assignee: Ricoh Company, Ltd., Japan

[21] Appl. No.: 433,920

[22] Filed: Oct. 12, 1982

[30] Foreign Application Priority Data

Oct. 12, 1981 [JP] Japan ..... 56-162515

[51] Int. Cl.[3] ..... B41J 13/02

[52] U.S. Cl. ..... 400/637.1; 400/550; 400/631; 400/636.1; 400/639.1

[58] Field of Search ..... 400/2, 320, 550, 631, 400/632, 632.1, 624, 625, 629, 636.1, 637.1, 639.1, 639.2, 674, 675, 705.5

[56] References Cited

U.S. PATENT DOCUMENTS

| | | | |
|---|---|---|---|
| 1,270,292 | 6/1918 | Hess | 400/637.1 |
| 1,270,979 | 7/1918 | Schwartz | 400/639.1 |
| 4,042,091 | 8/1977 | Levinson et al. | 400/639.1 X |
| 4,179,223 | 12/1979 | Kwan et al. | 400/320 |
| 4,225,249 | 9/1980 | Kettler et al. | 400/320 X |
| 4,266,880 | 5/1981 | Buchanan | 400/639.1 X |
| 4,275,969 | 6/1981 | Matsuhisa et al. | 400/639.1 X |

FOREIGN PATENT DOCUMENTS

| | | | |
|---|---|---|---|
| 0126470 | 9/1980 | Japan | 400/631 |
| 0144983 | 11/1981 | Japan | 400/639.1 |
| 0082070 | 5/1982 | Japan | 400/639.1 |
| 7807888 | 3/1979 | Netherlands | 400/631 |

OTHER PUBLICATIONS

IBM Technical Disclosure Bulletin, "Power-Operated Paper Insert Automatically Utilizing Triple Pitch for Typewriter", Lennon, vol. 22, No. 2, Jul. 1979, pp. 661-663.

IBM Technical Disclosure Bulletin, "Automotive First Writing Line Mechanism", Sweat, Jr., vol. 23, No. 9, Feb. 1981, pp. 3961-3964.

*Primary Examiner*—Ernest T. Wright, Jr.

*Attorney, Agent, or Firm*—Guy W. Shoup

[57] ABSTRACT

A method and system for semiautomatically setting a sheet of paper in a typewriter, printer and the like is provided. In accordance with the present invention, when a manually operable auto-set lever is moved from a first setting position to a second setting position, pressure and bail rollers are moved away from a platen roller around which a sheet of paper is to be set. At the same time, a carriage is moved to a first predetermined position of its travelling path. After inserting the leading edge of the sheet, when the auto-set lever is returned to the first setting position from the second setting position, the platen roller is driven to rotate with the pressure rollers in pressure contact therewith to advance the sheet over a predetermined distance along its line-feed direction and thereafter the carriage is moved to a second predetermined position during which the bail rollers are moved to press the sheet against the platen roller thereby setting the sheet ready for typing or printing.

16 Claims, 11 Drawing Figures

SEMIAUTOMATIC PAPER SETTING SYSTEM

BACKGROUND OF THE INVENTION

1. Field of the Invention

This invention relates to a semiautomatic paper setting system for use in typewriters, printers and the like, and, in particular, to a printer provided with a semiautomatic paper setting system in which a carriage is moved to a predetermined position prior to advancement of a paper around a platen roller to insure proper setting of paper at all times.

2. Description of the Prior Art

When certain information is to be typed or printed on a cut sheet of paper, the sheet must be first set in a typewriter or printer. FIG. 1 shows a typical prior art printer 1 in perspective with its top cover removed. As shown, the printer 1 includes a carriage 4 having thereon a print head 2 for forming printed characters on a cut sheet of paper and a guide plate 3 for guiding the advancement of the sheet as printing proceeds. The carriage 4 rides on a guide rail 7 fixedly provided in the printer 1 and extending in parallel with a platen roller 8 which is rotatably supported in the printer 1. The carriage 4 is fixedly connected to a wire 6 which is operatively connected to a carriage drive motor 5. Thus, when the motor 5 is driven to rotate, the carriage moves along the rail 7 in a reciprocating manner. On the other hand, the platen roller 8 is driven to rotate intermittently by means of a line-feed motor 9 thereby advancing the sheet of paper placed around the platen roller 8.

Also provided in the printer 1 are pressure rollers 10 and 11, which are operatively associated with a pressure roller lever 13. When the lever 13 is pushed forward, the pressure rollers 10 and 11 are moved away from the platen roller 8; whereas, when the lever 13 is pulled toward the operator, the pressure rollers 10 and 11 are brought into contact with the platen roller 8 under pressure as shown in FIG. 2. Moreover, paper bail rollers 12 are provided as rotatably supported by a bail lever 14 which is pivoted on the housing of the printer 1. The bail lever 14 may also take two positions; that is, the operative position in which the bail rollers 12 are lightly pressed against the platen roller 8 and the inoperative position in which the bail rollers 12 are spaced apart from the platen roller 8. Although not shown specifically, the printing position is defined between the pressure rollers 10 and the bail rollers 12 since the sheet of paper may be properly held at the desired position in this region.

In order to set a sheet of paper in the printer 1 prior to the printing operation, both of the levers 13 and 14 must first be operated so that the pressure rollers 10,11 and the bail rollers 12 are located away from the platen roller 8. Then a sheet of paper is manually inserted, and after correcting skewness, the levers 13 and 14 are again operated to bring the pressure rollers 10,11 and bail rollers 12 in the respective operative positions. Such a manual paper setting is quite cumbersome and the setting condition often changes from one sheet to another thereby causing misalignment in printing lines between different sheets. It is true that several attempts have been and are being made to alleviate the cumbersomeness of paper setting and to improve the printing quality in typewriters, printers and the like; however, none of these attempts is satisfactory and there has been a need for the advent of an improved system for setting a sheet of paper in typewriters, printers and the like.

SUMMARY OF THE INVENTION

The disadvantages of the prior art are obviated with the present invention and an improved system for setting a sheet of paper prior to typing or printing is herein provided. In accordance with the present invention, there is provided a semiautomatic paper setting system which is structured such that the carriage is first moved to a predetermined position, preferably the center position along the length of the platen roller, in response to a paper feed signal, and then a sheet of paper is advanced over a predetermined distance along the periphery of the platen roller and through the gap between the platen roller and the paper guide, which is fixedly mounted on the carriage, due to the rotation of the platen roller thereby setting the sheet ready for printing, followed by the step of moving the carriage to a predetermined desired position, e.g., home position. In this manner, in accordance with the present invention, the carriage is first moved to a predetermined position prior to the insertion of a sheet of paper, and carries a paper guide which will always be located to properly guide the sheet when it is inserted. This feature is important because the sheet must be placed between the platen roller and the paper guide of the carriage . The present invention enables a sheet of paper to be set properly at all times irrespective of the initial location of the carriage since it is first moved to a predetermined position in response to a paper feed signal.

Therefore, it is a main object of the present invention to provide an improved semiautomatic paper setting system for typewriters, printers and the like.

Another object of the present invention is to provide a semiautomatic paper setting method and apparatus capable of setting a sheet of paper properly at all times prior to a printing operation.

A further object of the present invention is to provide a semiautomatic paper setting method and apparatus capable of setting a wide variety of sheets of paper different in size.

A still further object of the present invention is to provide a semiautomatic paper setting system which requires only the one lever action and insertion of a sheet of paper for setting the sheet in position ready for printing.

A still further object of the present invention is to provide a typing/printing system in which a sheet of paper may be set semiautomatically.

Other objects, advantages and novel features of the present invention will become apparent from the following detailed description of the invention when considered in conjunction with the accompanying drawing.

DESCRIPTION OF THE PREFERRED EMBODIMENTS

Figure 6A:
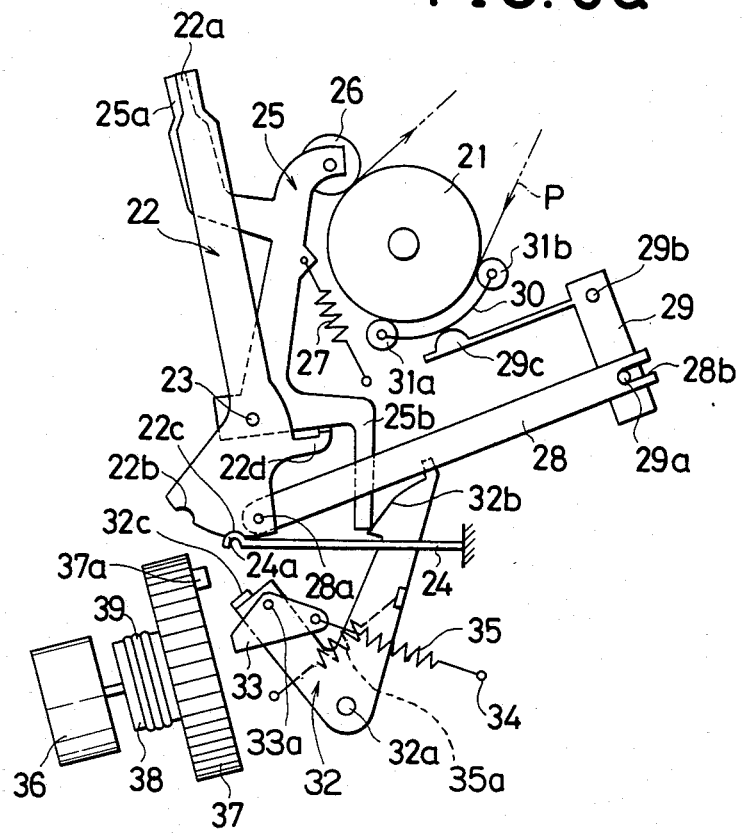
FIGS. 6*a* and 6*b* are schematic illustrations, which are shown separately for the sake of brevity, but, must, in fact, be combined together, showing the condition in which both of the pressure and bail rollers are brought into pressure contact with the platen roller and the registering pawls are moved away from the platen roller.
Figure 6B:
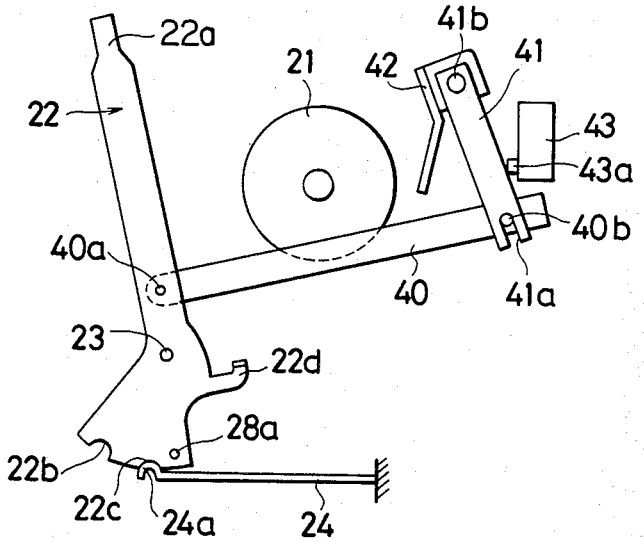

Now, an embodiment of the present invention will be described with reference to FIGS. 3 through 9. First, the mechanical aspect of the present system will be described with reference to FIGS. 6*a* and 6*b* illustrating the manner in which the present invention differs from conventional printers illustrated in FIG. 1. It is to be noted that FIGS. 6*a* and 6*b* show the normal printing condition in which printing may be effected on a sheet P of paper placed around a platen roller 21. As shown, the platen roller 21 is journaled in the housing (not shown) of the printer and it may be driven to rotate by means of a line-feed motor or it may be rotated manually. An auto-set lever 22 is pivoted to the housing at pivot 23. At the top end of the lever 22 is formed a handle 22*a* which may be held by fingers of the operator for pivoting the lever 22 around the pivot 23. The bottom end of the lever 22 is provided with a pair of notches 22*b* and 22*c* which may be selectively brought into engagement with the hook portion 24*a* formed at the forward end of a cantilevered leaf spring 24. Thus, the lever 22 may be manually pivoted around the pivot 23 to bring either one of the notches 22*b* and 22*c* into selective engagement with the hook portion 24*a*, and the lever 22 is temporarily held at the selected position unless it is again operated by the operator. It is to be noted that a projection 22*d* is provided as extending to the right from the lever 22 and bent into the drawing over a predetermined distance so that it may be brought into engagement with a bail lever 25 which is disposed in a side-by-side relation with the lever 22 and also pivoted at pivot 23.

The bail lever 25 rotatably supports an appropriate number of bail rollers 26 spaced apart from one another and arranged along the platen roller 21. The bail lever 25 is provided with a handle 25*a* and an angled section 25*b*. As may have already been understood, the projection 22*d* may be brought into engagement with the angled section 25*b*. A spring 27 extends between the bail lever 25 and a point on the housing so that the bail lever 25 is normally biased in the clockwise direction. Also provided is a first connecting lever 28 having one end pivotally connected to the bottom section of the auto-set lever 22 at pivot 28*a* and the other end 28*b* which is fork-shaped. The fork-shaped end 28*b* is in pivotal engagement with a pin 29*a* fixed to a first intermediate lever 29 which is pivoted to the housing at pivot 29*b*. Integrally formed with the first intermediate lever 29 is an actuating member 29*c* which may be comprised of a leaf spring. The actuating member 29*c* is in resilient contact with a roller support 30 which rotatably supports pressure rollers 31*a* and 31*b* on both ends. Thus, in the condition shown in FIG. 6*a*, a sheet P of paper is pressed against the platen roller 21 by means of the pressure rollers 31*a* and 31*b* and the bail rollers 26 so that when the platen roller 21 is rotated clockwise, the sheet P is advanced in the direction indicated by the two-dotted line.

Also provided is a release lever 32 which is formed generally in the shape of "V" and pivoted to the housing at pivot 32*a*. At one end of the release lever 32 is formed a cam surface 32*b* along which the bottom end of the angled section 25*b* of the bail lever 25 may move slidingly. The other end of the release lever 32 is provided with a clutch member 33 pivoted at pivot 33*a*. Between the clutch member 33 and a point 34 on the housing is extended a spring 35. The release lever 32 is also provided with a detent 32*c* which is engageable with the clutch member 33 to restrain its clockwise pivotal motion. There is also provided a carriage motor 36 fixedly mounted on the housing of the printer for rotating a gear wheel 37 and a drum 38 around which a part of wire 39 is wound. It is to be noted that a carriage is fixedly connected to the wire 39 and thus the carriage moves along the platen roller 21 as the motor 36 is driven to rotate in response to a control signal supplied thereto from the control unit, the details of which will be described later.

The structure shown in FIG. 6*b* should, in fact, be combined with the structure shown in FIG. 6*a* to constitute a complete mechanical arrangement in accordance with the present invention. It is to be noted that like numerals indicate like elements as practiced throughout the present specification. As shown in FIG. 6*b*, there is also provided a second connecting lever 40, one end of which is pivotally connected to the auto-set lever 22 at pivot 40*a* and the other end of which is provided with a pin 40*b*. The pin 40*b* is loosely fitted into the slot 41*a* formed at the bottom end of a second intermediate lever 41 having the other end pivoted to the housing at pivot 41*b*. A registering pawl 42 is provided integrally with the second intermediate lever 41 and thus the pawl 42 pivots around the pivot 41*b* together with the second intermediate lever 41. It is preferable to provide a plurality of such registering pawls 42 spaced apart from each other along the entire length of the platen roller 21. As shown in FIG. 6*b*, also provided is a microswitch 43 which is a normally closed type switch in this particular embodiment. Thus, while the feeler 43*a* of the microswitch 43 is being depressed, the microswitch 43 is kept turned off; whereas, it is turned on when the feeler 43*a* is undepressed. As will be fully described later, a signal from the microswitch 43 is supplied to the control unit of the present invention to control the paper setting operation semiautomatically.

Figure 3:
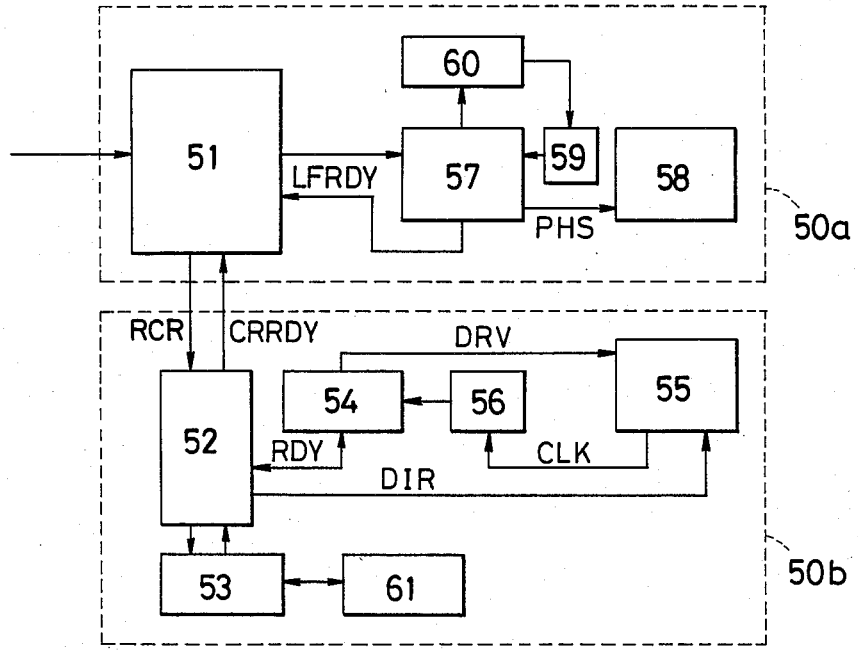
FIG. 3 is a block diagram showing the control unit which controls the sequence of paper setting operation in accordance with the present invention.

Referring now to FIG. 3, the control unit of the present semiautomatic paper setting system which controls the operation of the above-described mechanical arrangement will be described hereinbelow. The control unit of the present system generally comprises a line-feed control section 50*a* for controlling the line feed of a sheet P of paper and a carriage control section 50*b* for controlling the movement of the carriage. The line-feed control section 50*a* includes a main controller 51 which receives input signals supplied from other components of the printer such as microswitch 43 as described above. The main controller 51 supplies a control signal for controlling the line-feed operation of a sheet P of paper and it is also connected to a carriage controller 52 which forms a part of the carriage control section 50*b*. These main and carriage controllers 51 and 52 may be comprised of central processing units, if desired. Also provided in the carriage control section 50*b* and connected to the carriage controller 52 are a first carriage position counter 53 and a carriage step counter 54, which, in turn, is connected to a carriage driving source 55, which includes the carriage motor 36. The carriage driving source 55 is connected to supply a signal to a subtraction circuit 56 which in turn is connected to supply a signal to the carriage step counter 54. Also provided is a second carriage position counter 61 connected to the first carriage position counter 53.

Figure 1:
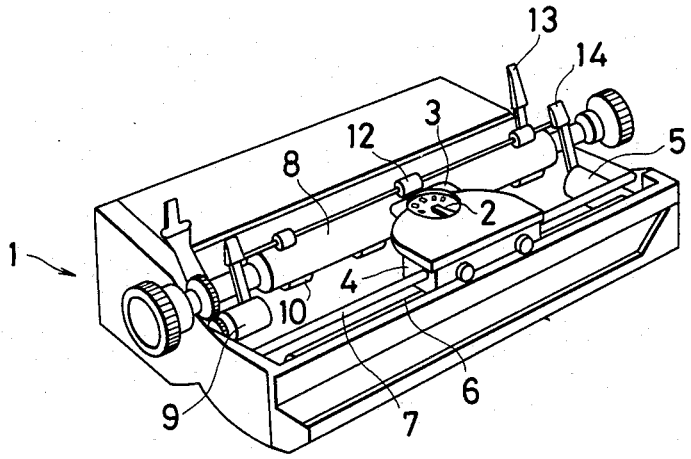
FIG. 1 PRIOR ART
FIG. 1 is a perspective view showing a typical prior art printer with its top cover removed.
Figure 2:
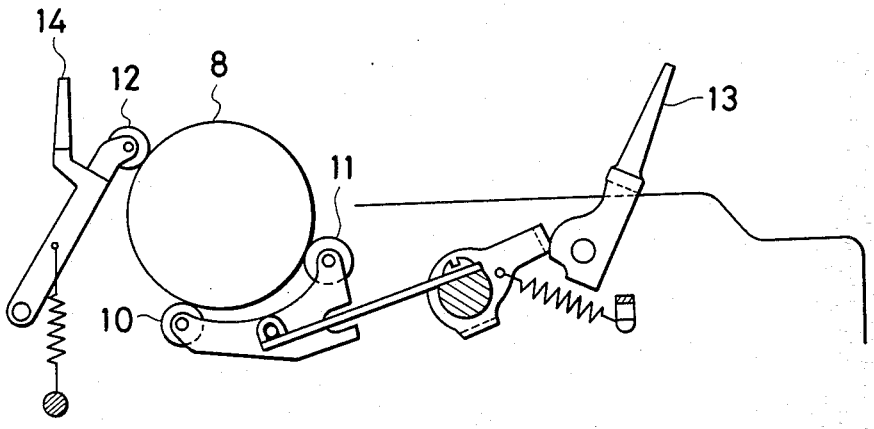
FIG. 2 PRIOR ART
FIG. 2 is a schematic illustration showing parts of the printer of FIG. 1 which is useful for explaining how a sheet of paper is set.

On the other hand, the main controller 51 is connected to a line-feed step control circuit 57 which is connected to supply a control signal to a line-feed mechanism 58, which includes a line-feed motor such as the motor 9 shown in FIG. 1. The line-feed step control circuit 57 is connected to form a loop with a subtraction circuit 59 and a timer 60. As will be described later, this loop controls the length of the top margin of a sheet P of paper to be set ready for printing. It is to be noted that all of the components shown in blocks are well known to those skilled in the art and thus no detailed explanation of these elements is presented here. However, it is worth noting in passing that use may be preferably made of central processing units, registers and other electronic components in forming the present control unit excepting the carriage driving source 55 and line-feed mechanism 58, which require motors and a power transmission device such as a gear train or wire. In a preferred embodiment, the main controller 51, line-feed step controller 57, subtraction circuit 59 and timer 60 are formed by a single central processing unit, and the carriage controller 52, first and second carriage position counters 53,61, carriage step counter 54 and subtraction circuit 56 are integrated into another one-chip central processing unit.

Figure 7A:
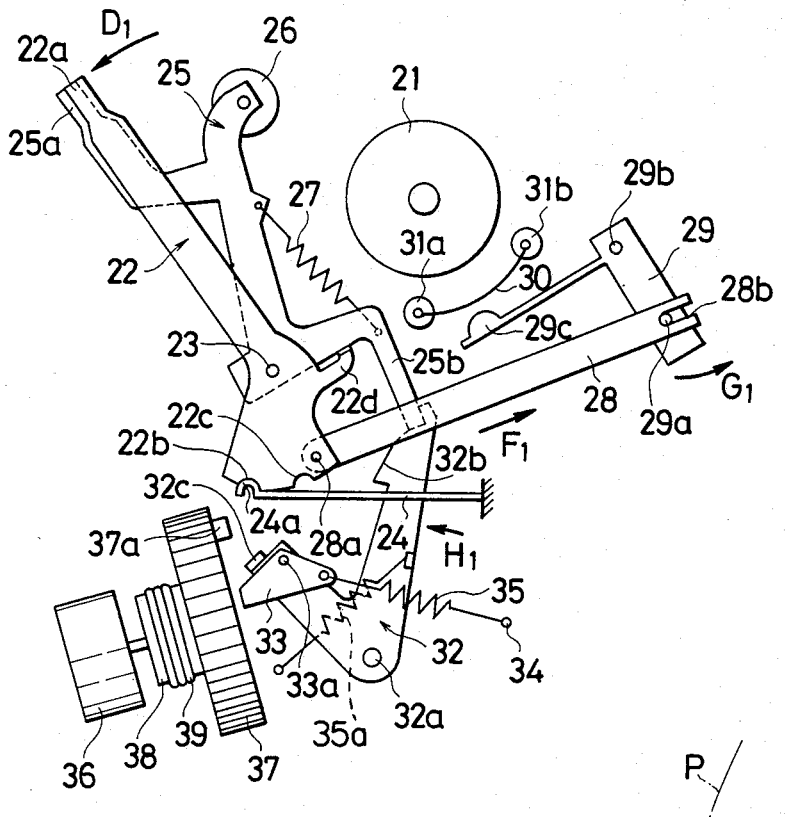
FIGS. 7*a* and 7*b* are schematic illustrations, which are shown separately for the sake of brevity, but, must, in fact, be combined together, showing the condition in which both of the pressure and bail rollers are moved away from the platen roller and the registering pawls are brought into contact with the platen roller.

In operation, when the operator pulls the auto-set lever 22 by gripping its handle 22*a* to initiate the paper setting operation, the auto-set lever 22 is pivoted around the pivot 23 in the direction indicated by the arrow $D_1$ as shown in FIG. 7*a*. As mentioned before, since the angled section 25*b* of the bail lever 25 is in engagement with the projection 22*d* of the auto-set lever 22, the bail lever 25 is also pivoted in the counter-clockwise direction as indicated by the arrow $D_1$. As the auto-set lever 22 is pivoted counter-clockwise, the hook portion 24*a* of the leaf spring 24 comes into engagement with the notch 22*b*, and, thus, the auto-set lever 22 together with the bail lever 25 is now held at the position shown in FIG. 7*a*.

The counter-clockwise pivotal motion of the auto-set lever 22 also causes the first connecting lever 28 to shift in the direction indicated by the arrow $F_1$ so that the intermediate lever 29 swings around the pivot 29*b* in the direction indicated by the arrow $G_1$ thereby causing the actuating member 29*c* and thus the pressure rollers 31*a*, 31*b* to move away from the platen roller 21 to form a gap between the pressure rollers 31*a*, 31*b* and the platen roller 21. On the other hand, since the bail lever 25 is also forced to pivot counter-clockwise, the bottom end of the angled section 25*b* slides along the cam surface 32*b* to the right and therefore the "V"-shaped release lever 32 rotates counter-clockwise as indicated by the arrow $H_1$ owing to the profiled shape of the cam surface 32*b* and the spring 35*a*. As a result, the clutch member 33 comes to be located at the position closer to the gear wheel 37 and thus the clutch member 33 now may be brought into engagement with a projection 37*a* formed at the periphery of the gear wheel 37 as it rotates. It is to be noted that when the bail lever 25 is in operative position as shown in FIG. 6*a*, the clutch member 33 is located sufficiently away from the projection 37*a* so that no engagement between these elements occurs when the gear wheel 37 rotates. It should further be noted that under the condition shown in FIG. 7*a*, even though the projection 37*a* comes into engagement with the clutch member 33 as the gear wheel 37 rotates, if the gear wheel 37 rotates clockwise as viewed from the left, the release lever 32 maintains the position shown in FIG. 7*a* because the clutch member 33 will pivot back and forth around the pivot 33*a* every time when the projection 37*a* comes into engagement as the gear wheel 37 rotates. On the other hand, if the gear wheel 37 rotates in the opposite direction, i.e., counter-clockwise as viewed from the left, the release lever 32 will be forced to pivot clockwise around the pivot 32*a* because of the engagement between the clutch member 33 and the detent 32*c*, the details of which will be described later.

Figure 7B:
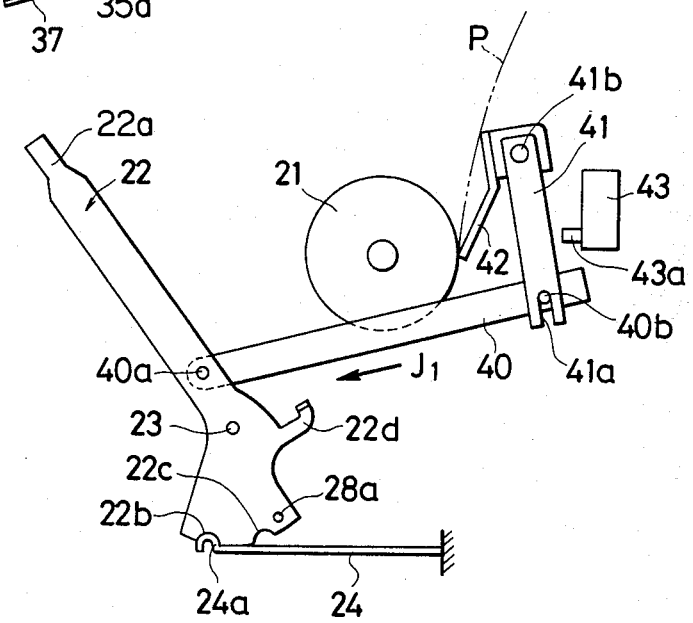

As shown in FIG. 7*b*, the counter-clockwise pivotal motion of the auto-set lever 22 also causes the second connecting lever 40 to move to the left as shown by the arrow $J_1$ which then causes the second intermediate lever 41 to pivot clockwise around the pivot 41*b* thereby bringing the tip end of the registering pawl 42 in contact with the peripheral surface of the platen roller 21. More importantly, when the auto-set lever 22 is shifted in the direction $D_1$, the second intermediate lever 41 is pivoted clockwise through the lever 40 to be separated away from the feeler 43*a* of the microswitch 43 and thus the microswitch 43 is turned on because it is assumed to be a normally closed switch in this embodiment.

Figure 4:
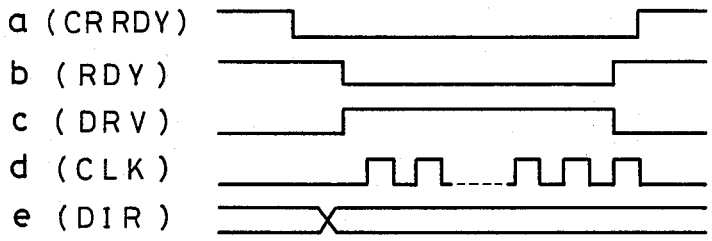
FIGS. 4 and 5 are timing diagrams which are useful for explaining the operation of the control unit shown in FIG. 3.
Figure 5:
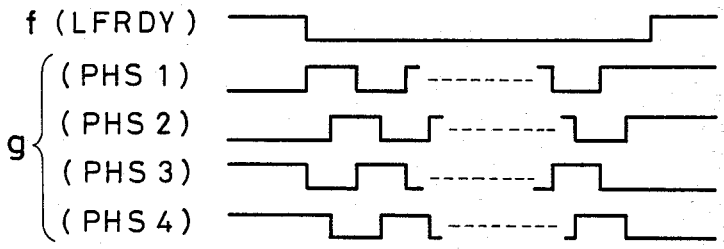

When the microswitch 43 is turned on, a signal is supplied to the main controller 51 of the control unit shown in FIG. 3. Then the main controller 51 receives another signal indicating the current position of the carriage along the reciprocating travelling path in terms of the number of steps N1 as measured from the home position of the carriage which is usually defined at one end of the travelling path . In this respect, it should be noted that provision must be made of a position detector for detecting the current position of the carriage along its travelling path as well known in the art. Such a measured step number N1 is then fed to the carriage controller 52 as long as the main controller 51 is receiving a carriage ready signal "CRRDY" from the carriage controller 52, as shown in FIG. 4. If the carriage controller 52 is busy, it does not supply "CRRDY" to the main controller 51 and thus no signal may be fed to the carriage controller 52 from the main controller 51.

Then the carriage controller 52 exchanges the value N1 with a predetermined number N2 of steps stored in the first carriage position counter 53 and at the same time executes the calculation of $M=N2-N1$. Then the carriage controller 52 supplies the calculated value M to the carriage step counter 54; on the other hand, the carriage controller 52 also supplies a sign signal "DIR"

to the carriage driving source 55. The signal "DIR" is set high if the calculated value M is negative; whereas, it is set low if M is positive in value, as shown in FIG. 4. As may have been already noticed, the value M signifies the number of steps for this carriage to reach a predetermined position along the travelling path, i.e., the center position in the present embodiment. It is to be noted that such a predetermined position along the carriage travelling path may be arbitrarily determined beforehand by storing an appropriate value for N2 in the first carriage position counter 53. Alternatively, it may also be so structured that the value of N2 is selectively determined externally by those skilled in the art without any difficulty.

When the carriage controller 52 exchanges information with the first carriage position counter 53, the information stored in the counter 53 prior to the exchanging operation is simultaneously transferred to the second carriage position counter 61. Accordingly, after the exchanging operation, the first carriage position counter 53 stores information N1 and the second carriage position counter 61 stores information N2. Upon receipt of the calculated value M from the carriage controller 52, the carriage step counter 54 supplies a drive signal "DRV" to the carriage driving mechanism 55 as shown in FIG. 4. As a result, the driving source 55 starts to rotate the carriage motor 36 so that the carriage will move in parallel with the platen roller 21 in the direction determined by the direction signal "DIR" which dictates the rotational direction of the motor 36.

Under this condition, every time when the carriage driving source 55 completes one step of carriage moving operation, it supplies a clock pulse signal "CLK", as shown in FIG. 4, to the subtraction circuit 56 whereby the number stored in the carriage step counter 54 is decremented by the value "1". When the number of the counter 54 has reached "0", the driving signal "DRV" is turned low to deactivate the driving source 55, and, at the same time, it changes the "RDY" signal high to apprise the carriage controller 52 of the fact that the movement of the carriage to a desired position has been completed. At the same time, the carriage controller 52 supplies a carriage motion completion signal "CRRDY" to the main controller 51 to indicate that the carriage has been moved to a desired position, e.g., the center of the reciprocating travelling path. In this manner, the carriage is always moved to a desired position along its travelling path, the center in the present embodiment; as a first step in the paper setting operation, the paper guide of the carriage can be located such that a sheet P of paper may be properly inserted between the platen roller 21 and the paper guide at all times irrespective of the initial position of the carriage.

Figure 8:
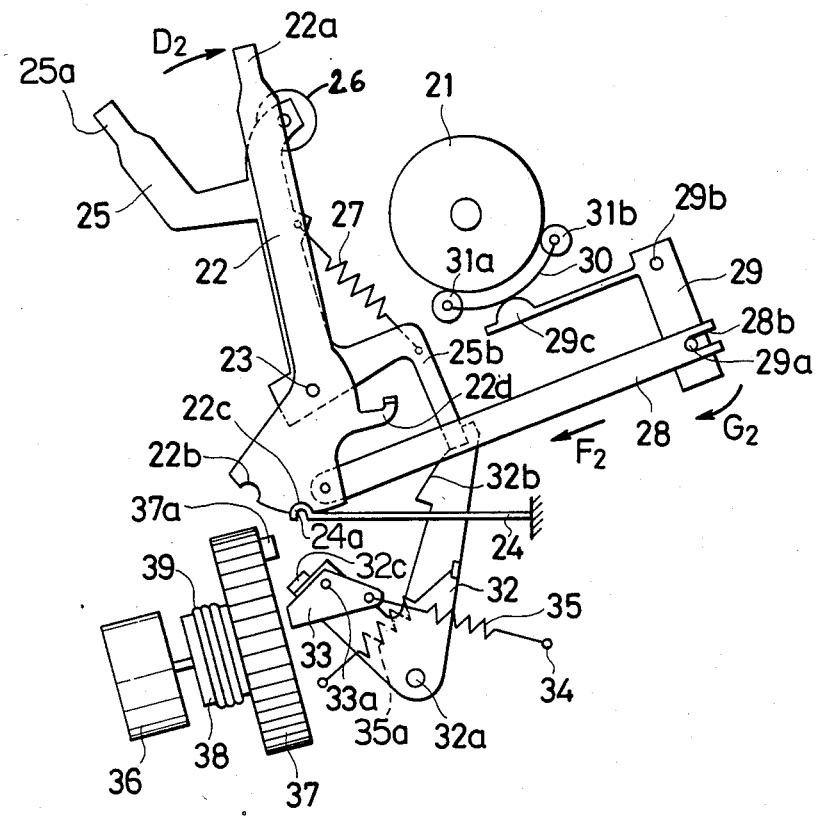
FIG. 8 is a schematic illustration showing the condition in which the pressure rollers are again brought into pressure contact with the platen roller but the bail rollers are still held away from the platen roller.

Then a sheet P of paper must be inserted by the operator. In this instance, as shown by the two-dotted line in FIG. 7*b*, the skewness of the sheet P may be readily corrected by bringing the leading edge of the sheet P into abutment against the contact points between the bottom ends of the respective registering pawls 42 and the platen roller 21. After inserting the sheet P as described above, the operator pivots the auto-set lever 22 by gripping the handle 22*a* in the direction indicated by the arrow $D_2$ as shown in FIG. 8 until the hook portion 24*a* again comes into engagement with the notch 22*c*. Such a pivotal motion of the auto-set lever 22 causes the first connecting lever 28 to move leftward as indicated by the arrow $F_2$, which, in turn, causes the intermediate lever 29 to pivot clockwise as indicated by the arrow $G_2$ so that the pressure rollers 31*a*, 31*b* are brought into pressure contact with the platen roller 21. It is to be noted that the bail lever 25 and its associated release lever 32 are left as they were because the clockwise rotation of the auto-set lever 22 only causes its projection 22*d* to move away from the angled section 25*b* of the bail lever 25. It should also be noted that such a clockwise rotation of the auto-set lever 22 causes the second connecting lever 40 to move to the right so that the second intermediate lever 41 together with the registering pawls 42 are swung counter-clockwise around the pivot 41*b* whereby the pawls 42 are moved away from the platen roller 21 to define a gap for passage of the sheet P of paper, and, at the same time, the lever 41 depresses the feeler 43*a* to cause the microswitch 43 to be turned off. Such a condition may be illustrated by a combination of FIGS. 8 and 6*b*.

When the microswitch 43 is turned off as described above, a line-feed signal is supplied to the main controller 51 from the microswitch 43 , and thus the main controller 51 supplies information as to the number N3 of steps corresponding to a predetermined top margin of the sheet P to be positioned around the platen roller 21 to the line-feed step control circuit 57 as long as the main controller 51 is receiving a line-feed ready signal "LFRDY" from the line-feed step control circuit 57. Then the line-feed step control circuit 57 supplies a phase signal "PHS" corresponding to a single step in normal direction to the line-feed driving mechanism 58 which includes a step motor and at the same time starts the timer 60. It is to be noted that the present embodiment uses the four phase control in line-feed operation as obvious from the waveforms g shown in FIG. 5. When the timer 60 has counted a predetermined time period, it supplies a signal to the subtraction circuit 59 which in turn sends a signal to the line-feed step control circuit 57 to decrement the current number N3 of steps stored therein by the amount "1."

As is obvious, every time when the number N3 of steps stored in the line-feed step control circuit 57 is decremented by "1" in response to the signal from the subtraction circuit 59, the circuit 57 sends a signal "PHS" to the driving mechanism 58 to cause the platen roller 21 to rotate over a predetermined angle corresponding to a single step. Such an operation is repeated to advance the sheet P of paper around the path defined around the platen roller 21 until the print head comes to be located at the bottom of a predetermined top margin. Then, when the number N3 of steps has become "0", i.e., the sheet P having been positioned at the printing start position, the line-feed step control circuit 57 changes the state of the signal "LFRDY" to apprise the main controller 51 of the fact that the top margin line-feed operation has been completed.

Thereafter, the main controller 51 supplies a signal "RCR" to the carriage controller 52. This signal is to move the carriage of the printer to a predetermined position such as the home position defined at one end of the carriage travelling path to set up the condition ready for starting printing operation. Upon receipt of the "RCR" signal, the carriage controller 52 causes the counter 61 to transfer its contents currently stored therein to the controller 52 and furthermore causes the counters 53 and 61 to have their contents exchanged from each other. As a result, the carriage controller 52 comes to possess the value N1; on the other hand, the first and second carriage position counters 53 and 61 come to possess the values N2 and N1, respectively.

Then, after executing the calculation of N=N1−N2, the carriage controller 52 sets the state of the direction signal "DIR" depending upon the sign of the calculated value N. Then, the controller 52 supplies the calculated value N to the carriage step counter 54. Accordingly, the carriage driving source 55 is once again activated to move the carriage of the printer to the initial location, i.e., home position defined at the left end of the carriage travelling path in a preferred embodiment of the present invention.

Figure 9:
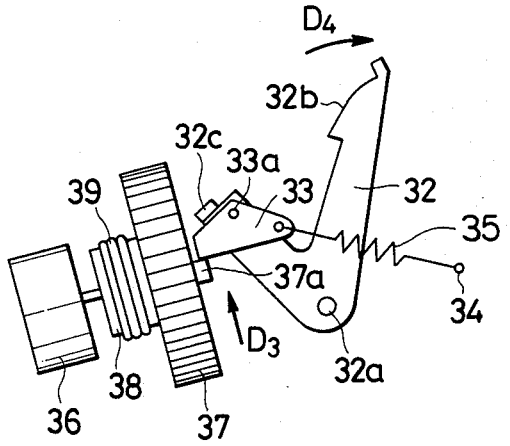
FIG. 9 is a schematic illustration showing the parts of the structure shown in FIG. 8 which is useful for explaining the automatic return of the bail rollers in accordance with the present invention.

When the carriage is moved to the home position defined at the left end of the carriage travelling path in accordance with the preferred mode of the present invention, the gear wheel 37 will be driven to rotate counter-clockwise as viewed from the left in FIG. 9, so that the projection 37*a* of the gear wheel 37 will now be brought into engagement with the clutch member 33 from its bottom as indicated by the arrow $D_3$ shown in FIG. 9. As a result, as the gear wheel 37 rotates as described above, the release lever 32 is forced to pivot clockwise around the pin 32*a* as indicated by the arrow $D_4$ in FIG. 9. Such a pivotal motion of the release lever 32 then causes the bail lever 25 to pivot clockwise around the pin 23 due to the sliding contact between the cam surface 32*b* and the bottom edge of the angled section 25*b* and the recovery force of the spring 27. Therefore the bail rollers 26 are brought back to their operative positions automatically to press the now existing sheet P against the platen roller 21. It is to be noted, however, that the present invention is not limited to this mode and use may be made of other structures for carrying out the automatic returning of the bail rollers 26. For example, a piston-cylinder mechanism or electromagnetic solenoid may be used to control the pivotal motion of the release lever 32 instead of the projection 37*a* and clutch 33 combination as in the present embodiment. When use is made of an electromagnetic solenoid, it may be so structured that a signal is fed from the control unit to activate the solenoid for controlling the pivotal motion of the lever 32. However, the above-described embodiment is preferred because it is much simpler in structure.

Following the sequence as described above, a sheet P of paper may be set semiautomatically with ease and thus printing operation may be started right away. It is to be noted that various modifications manifest themselves from the above described embodiments for those skilled in the art without departing from the spirit and scope of the present invention. For example, it may be so structured that the carriage is first moved over a predetermined distance in a predetermined direction along its travelling path, then a sheet P of paper is advanced in the line-feed direction by the amount of top margin, and then the carriage is returned to its original location. In such a structure, there is no need to provide a position sensor because the movement of the carriage is determined depending upon the current position of the carriage prior to the initiation of the paper setting operation. In this modification, it is preferable to structure such that the carriage always returns to its home position defined at the left end of the travelling path.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A method for semiautomatically setting a sheet of paper in a device such as a typewriter and printer prior to an operation of printing information on said sheet, said device including a platen roller around which a sheet of paper is to be set, a carriage which is provided reciprocatingly movably along its travelling path defined in parallel with said platen roller, said carriage being provided with a print head for forming printed information on said sheet and means including a paper guide for guiding the advancement of said sheet around said platen roller during the paper setting operation, and a control unit for controlling the semiautomatic paper setting operation, said method comprising the steps of:

moving said carriage to a first predetermined position which is approximately at the center of said sheet of paper across its widthwise direction under the control of said control unit when a paper setting initiation signal is supplied thereto;

advancing said sheet around said platen roller over a predetermined distance under the control of said control unit when a line-feed control signal is supplied thereto after having the leading edge of said sheet inserted into said printer with said carriage located at said first predetermined position whereby said sheet is properly located between said platen roller and said paper guide; and moving said carriage to a second predetermined position along said travelling path thereby completing the paper setting operation.

2. A method as defined in claim 1 wherein said first predetermined position is the center position of said travelling path.

3. A method as defined in claim 1 or 2 wherein said second predetermined position is the initial position of said carriage prior to the movement to said first predetermined position.

4. A method as defined in claim 1 wherein said second predetermined position is the home position of said carriage which is defined at one end of said travelling path.

5. A method as defined in claim 1 wherein said predetermined distance over which said sheet is advanced in response to said line-feed control signal corresponds to the length of the top margin of said sheet.

6. A method as defined in claim 1 further comprising a step of checking whether or not said control unit is in a ready state prior to the movement of said carriage upon receipt of said paper setting initiation signal.

7. A method as defined in claim 1 further comprising a step of determining an amount and direction of movement of said carriage prior to the movement of said carriage.

8. A method as defined in claim 1 further comprising a step of determining an amount and direction of movement of said carriage after insertion of said sheet of paper into said printer.

9. A typing/printing system in which a sheet of paper may be set semiautomatically prior to typing/printing operation, said system comprising:

a platen roller around which said sheet is to be set;

first driving means for rotating said platen roller;

a carriage having mounted thereon a typing/printing head for typing/printing desired information on said sheet and means including a paper guide for defining a paper passage gap with said platen roller, said carriage being provided reciprocatingly movably along the length of said platen roller;

second driving means for moving said carriage along a travelling path defined in parallel with the longitudinal axis of said platen roller;

first holding means movable into an operative position for holding said sheet against said platen roller at a first holding position and an inoperative position separated away from said platen roller;

first control means including a manually operable auto-set lever for controlling the location of said first holding means such that said first holding means is located at said operative position when said auto-set lever is at a first setting position and at said inoperative position when said auto-set lever is at a second setting position;

second holding means movable into an operative position for holding said sheet against said platen roller at a second holding position and an inoperative position separated away from said platen roller;

second control means for controlling the location of said second holding means at either said operative or inoperative position;

switch means which is operated when said auto-set lever is changed from either one of said first and second setting positions to the other; and means including a control unit including at least one central processing unit for controlling the driving conditions of said first and second driving means, said control unit sending a first signal to said driving means to move said carriage to a first predetermined position which corresponds approximately to the center of said sheet of paper across its widthwise direction in response to a first control signal supplied from said switch means when said auto-set lever is moved from said first setting position to said second setting position and said control unit sending a second signal to said first driving means to rotate said platen roller to advance said sheet of paper over a predetermined distance in the line-feed direction and then sending a third signal to said second driving means to move said carriage to a second predetermined position along said travelling path in response to a second control signal supplied from said switch means when said auto-set lever is moved from said second setting position to said first setting position.

10. A system as defined in claim 9 wherein said first control means includes a link mechanism which operatively connects said auto-set lever to said first holding means, including an appropriate number of pressure rollers.

11. A system as defined in claim 9 or 10 wherein said second holding means includes at least one bail roller and said second control means includes a first lever, which is pivotally provided and supports said bail roller rotatably, and a second lever which is pivotally provided, said first and second levers being operatively connected such that the pivotal motion of one of said first and second levers may cause the associated pivotal motion of the other.

12. A system as defined in claim 9 further comprising at least one registering pawl which may be located at the operative position with its tip end in contact with said platen roller for defining a reference line for the leading edge of said sheet to be inserted or at the inoperative position separated away. from said platen roller, the location of said registering pawl being controlled by said auto-set lever.

13. A system as defined in claim 9 wherein said first predetermined position is the center position of said travelling path.

14. A system as defined in claim 9 wherein said predetermined distance over which said sheet is advanced in the line-feed direction corresponds to the top margin of said sheet.

15. A system as defined in claim 9 wherein said second predetermined position is the initial position of said carriage prior to the movement to said first predetermined position.

16. A system as defined claim 9 wherein said second predetermined position is the home position defined at one end of said travelling path.

* * * * *